United States Patent [19]

Poe

[11] 4,397,895

[45] Aug. 9, 1983

[54] CHRISTMAS TREE DISPLAY STAND

[76] Inventor: Joseph P. Poe, Rte. 1, Box 243, West Jefferson, N.C. 28694

[21] Appl. No.: 177,575

[22] Filed: Aug. 13, 1980

[51] Int. Cl.[3] ..... A47G 33/06

[52] U.S. Cl. ..... 428/18

[58] Field of Search ..... 248/27.8, 309 A, 349, 248/519, 521, 522, 523, 525, 544; 211/57.1, 59.1, 163; 428/8, 18, 19, 20

[56] References Cited

U.S. PATENT DOCUMENTS

| | | | |
|---|---|---|---|
| 328,007 | 10/1985 | Coffin | 248/524 |
| 395,766 | 1/1889 | Westphal | 248/521 |
| 1,015,934 | 1/1912 | Black, Jr. | 248/523 |
| 1,450,807 | 4/1923 | Hines | 248/529 |
| 1,598,016 | 8/1926 | Runser | 248/524 |
| 1,733,011 | 10/1929 | Healy et al. | 248/524 |
| 1,823,608 | 9/1931 | Kalkanis | 248/349 X |
| 2,626,062 | 1/1953 | Manzella | 211/59.1 |
| 2,681,780 | 6/1954 | Santoro | 248/524 |
| 2,743,499 | 5/1956 | Edgerton | 248/523 X |
| 2,840,331 | 6/1958 | Clifton | 248/529 |
| 3,420,468 | 1/1969 | Rhoades | 211/59.1 |
| 3,648,957 | 3/1972 | Bencriscutto | 248/45 |
| 3,743,225 | 7/1973 | Bochinski | 247/27.8 |

*Primary Examiner*—William H. Schultz

*Attorney, Agent, or Firm*—Bell, Seltzer, Park & Gibson

[57] ABSTRACT

A rotatable stand is provided which is particularly designed for supporting and displaying a tree for sale on a Christmas tree lot, and which is characterized by permitting quick and easy installation of the tree in the stand. The stand includes a base adapted to be positioned on the ground and a rotatable tree support rotatably mounted above the base and adapted for receiving and supporting a Christmas tree therein. The tree support includes a support platform and at least three elongate upright tree support members mounted on the support platform and extending longitudinally alongside the tree trunk with the tree branches extending outwardly between the upright support members and serving to assist in holding the tree in a stable upright position.

9 Claims, 3 Drawing Figures

CHRISTMAS TREE DISPLAY STAND

FIELD OF THE INVENTION

This invention relates to a display stand for a Christmas tree, and is particularly designed for supporting and displaying a Christmas tree at a Christmas tree lot to enable customers to readily inspect and examine the tree.

BACKGROUND OF THE INVENTION AND PRIOR ART

At Christmas tree lots or other locations where Christmas trees are sold, it is generally desirable to display the tree in its natural upright orientation to enable the customer to examine the tree and to determine its shape, the density of the branches, and the freshness of the tree. Where the trees are stored in piles, this is done by manually holding the tree upright while the customer examines the tree. However, frequently the trees are mounted upright by tying them to stakes driven in the ground or by nailing or otherwise securing a support stand to the base of the tree.

Tree stands of various types are shown in the prior art, and the patents listed below are believed to be representative of the prior art in this field:

| U.S. Pat. No. | Inventor | Issue Date |
|---|---|---|
| 328,007 | Coffin | October 13, 1885 |
| 1,015,934 | Black, Jr. | January 30, 1912 |
| 1,450,807 | Hines | April 3, 1923 |
| 1,598,016 | Runser | August 31, 1926 |
| 1,733,011 | Healey et al | October 22, 1929 |
| 2,681,780 | Santoro | June 22, 1954 |
| 2,840,331 | Clifton | June 24, 1958 |
| 3,648,957 | Bencriscutto | March 14, 1972 |

The above-noted prior art tree stands are primarily concerned with supporting the tree for display when the tree has been decorated, and are characterized in that the tree is supported and held only at the lowermost portion of its trunk. This type of stand is not well suited for supporting and displaying Christmas trees for sale, because of the undue amount of time required to install the stand on the tree.

Accordingly, it is a primary object of this invention to provide a display stand which is particularly designed for supporting and displaying a tree for sale on a Christmas tree lot to enable customers to examine and inspect the tree, and which is characterized by permitting quick and easy installation of the tree in the stand and the subsequent easy removal thereof. It is a further object of this invention to provide a display stand of this type which is rotatable so as to enable the customer to readily examine all sides of the tree.

It is a further object of this invention to provide a display stand of the type described which will accommodate a wide variety of sizes of trees, and which will support them in a stable upright orientation.

SUMMARY OF THE INVENTION

The above and other objects are achieved in accordance with the present invention by the provision of a rotatable display stand which comprises a base adapted to be positioned on the ground, a rotatable tree support positioned above the base and adapted for receiving and supporting a Christmas tree therein, and means mounting the tree support for rotation with respect to the base to thereby enable rotating the tree for examining and inspecting all sides thereof. The rotatable tree support comprises a support platform adapted for engaging and supporting the lower end of the tree trunk and at least three upright support members carried by the support platform and extending upwardly therefrom. The support members are mounted in spaced apart relation from one another for substantially surrounding the tree trunk and are of a length such as to extend well above the lowermost branches of the tree and into the middle portions of the tree so that the tree branches extend outwardly between the upright support members and serve to assist in holding the tree in a stable upright position.

Preferably, the tree support has a hole in the lower end thereof, and is mounted for rotation to the base by means of a pin carried by the base and projecting upwardly therefrom and into the hole in the lower end of the tree support. This permits the tree support to be readily rotated with respect to the base and also permits the tree support to be easily removed from and reconnected to the base to facilitate inserting a tree into the tree support. Desirably, a bearing is provided associated with the pin and positioned between the base and the lower end of the tree support for reducing friction between the base and the tree support during rotation of the tree support.

The upright support members which serve for supporting and maintaining the tree in an upright orientation preferably comprise respective elongate slender rods which are connected to the support plate and extend upwardly therefrom in substantially parallel relation to one another. The upper ends of the respective elongate rods are preferably tapered to facilitate inserting the tree support longitudinally into the tree from the trunk end thereof. The elongate rods desirably have a length at least about 3 feet so as to accommodate and securely support trees of a wide range of heights.

BRIEF DESCRIPTION OF THE DRAWINGS

Some of the objects, features and advantages of the invention having been stated, others will become apparent as the description proceeds, when taken in connection with the accompanying drawings, in which.

DESCRIPTION OF THE ILLUSTRATED EMBODIMENT

Figure 1:
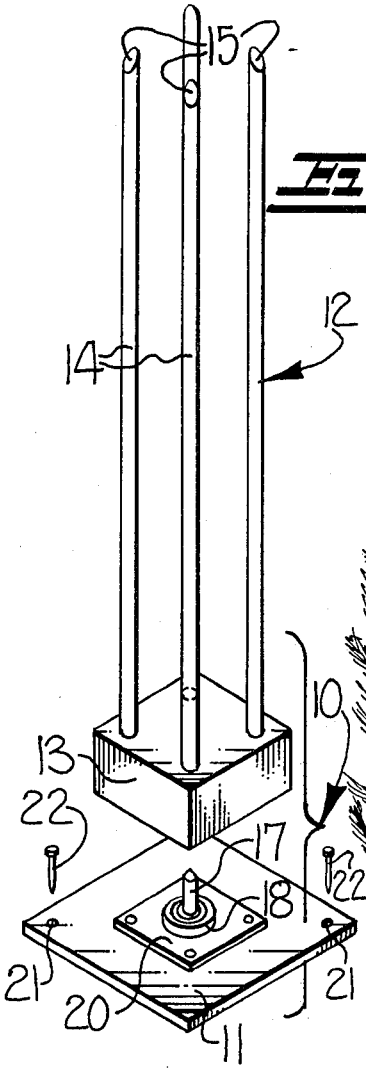
FIG. 1 is an exploded perspective view showing the display stand of this invention.
Figure 2:
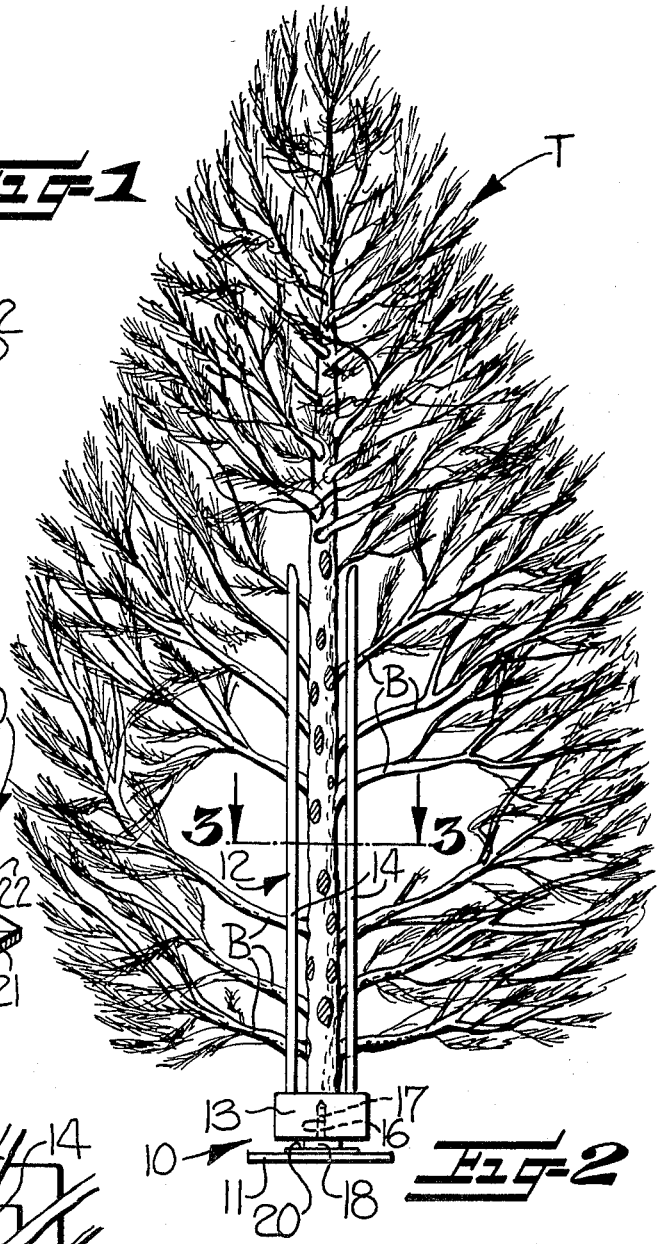
FIG. 2 is a side elevational view of the display stand, with a Christmas tree, shown partially in section, positioned in the display stand.
Figure 3:
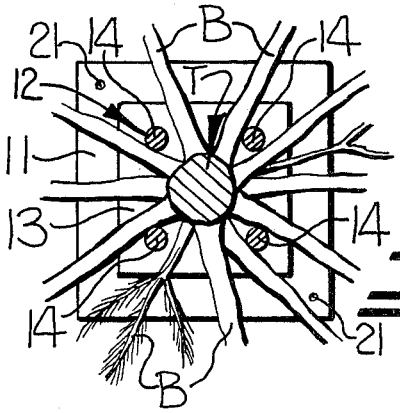
FIG. 3 is a cross-sectional view through the tree and stand taken substantially along the line 3—3 of FIG. 2.

Referring now more particularly to the drawings, a rotatable display stand constructed in accordance with this invention is indicated in the drawings by the reference character 10. As illustrated, the display stand 10 includes a base 11, shown in the form of a relatively flat plate, which is adapted to be positioned on the ground. The display stand additionally includes a compact, relatively tall rotatable tree support, generally indicated at 12, which is adapted for receiving and supporting a Christmas tree therein. The base 11 has a width on the order of about one to one and one-half feet, while the overall height of the display stand is several times the width of the base. The tree support 12 includes a support platform 13 of a generally blocklike configuration and several upright support members 14 which are carried by the support platform 13 and extend upwardly therefrom in generally parallel relation to one another. The support members 14 are mounted in substantially uniformly spaced apart relation from one another for accommodating the trunk of a Christmas tree T therebetween, and it will be seen that the support members 14 are of a length such as to extend upwardly well above the lowermost branches of the tree T and into the middle portions of the tree so that the laterally extending tree branches B (FIG. 3) extend outwardly between the upright support members 14. The branches B thus engage and cooperate with the support members to prevent wobbling of the tree and thus assist in holding the tree in a stable upright position.

At least three upright support members are needed in order to substantially surround and adequately engage and support the tree and hold it in place. When three support members 14 are used, they are preferably positioned in spaced relation from one another at three corners of an equilateral triangle. In the illustrated embodiment, four support members are used and they are arranged at four corners of a square. Preferably, the support members are either three or four in number. It will be appreciated that if significantly more than four support members are used, it becomes difficult to insert the stand into the tree because of the interference of the laterally extending branches B of the tree.

The support members are spaced apart from one another a sufficient distance for accommodating and surrounding the average size tree. This distance is less than a foot, and preferably on the order of six to eight inches. The relatively close, uniform spacing of the support members serves to assist in centering the support members in substantially surrounding relation to the tree trunk when the tree support 12 is pushed longitudinally into the tree during installation.

The length of the support members is manyfold greater than the spacing therebetween, with the support members 14 having a length so as to extend well up into the middle portions of the tree. For the size Christmas trees conventionally encountered, the support members 14 are preferably at least about 3 feet in length. In the illustrated embodiment, the support members are in the form of elongate slender rods of a smooth uninterrupted generally circular cross-section and the upper ends 15 of the rod-shaped support members 14 are cut on a diagonal to give a pointed, tapered configuration which facilitates inserting the tree support 12 into the tree.

In this regard, it will be understood that the tree support 12 is generally inserted into the tree while the tree is lying on its side by positioning the pointed upper ends 15 of the stand adjacent the trunk end of the tree and then pushing the tree support 12 longitudinally into the tree so that the support members 14 pass between the outwardly extending branches B of the tree. Then the thus inserted tree support 12 and the tree are lifted and the tree support is positioned on the base 11.

To facilitate examining the tree on all sides thereof, means is provided for mounting the tree support 12 for rotation with respect to the base 11. As illustrated, the support platform 13 has a centrally located vertically extending hole 16 formed therein and a pin 17 is mounted on the base 11 and projects upwardly therefrom so as to be positionable within the hole 16 in the support platform 13. To facilitate free rotation of the tree support 12 with respect to the base, a bearing 18 is provided on the base 11 surrounding the pin 17. The bearing 18 is constructed with freely movable upper and lower surfaces which are adapted for respectively engaging the lower end of the support 12 and the base 11 so as to reduce friction therebetween when rotating the tree support. In the particular embodiment illustrated, the pin 17 and bearing 18 are both mounted on a base flange 20 which, in turn, is secured by screws or other suitable means to the relatively broad flat base plate 11.

The compact, relatively tall configuration of the tree support 12 and the secure manner in which the tree is held in place by the closely spaced upright support members 14 provides very good stability to the display stand even though the width of the base 11 is only a fraction of the height of the display stand. Although not required, it may be desirable in some instances to secure the base plate 11 to the ground, and for this purpose holes 21 may be provided in the base plate through which spikes 22 or other suitable means may be driven into the ground to provide a more firm securement with the ground.

It will thus be seen that the display stand of the present invention is particularly well suited for supporting and displaying a Christmas tree in a stable upright position for examination and inspection by prospective customers.

In the drawings and specification there has been set forth a preferred embodiment of the invention and although specific terms are employed, they are used in a generic and descriptive sense only and not for purposes of limitation.

What is claimed is:

1. In combination, a Christmas tree having a trunk and branches extending laterally therefrom, and a rotatable display stand for supporting and displaying said tree, said display stand comprising a base adapted to be positioned on the ground, a rotatable tree support positioned above said base and receiving and supporting said Christmas tree therein, and means mounting said tree support for rotation with respect to said base to thereby enable rotating the tree for examining and inspecting all sides thereof, said rotatable tree support comprising a support platform engaging and supporting the lower end of the tree trunk and at least three upright support members carried by said support platform and extending upwardly therefrom, said support members being mounted in spaced apart relation from one another and substantially surronding the tree trunk and being of a length such as to extend well above the lowermost branches of the tree and into the middle portions of the tree so that the tree branches extend outwardly between said upright support members and serve to assist in holding the tree in a stable upright position.

2. A display stand according to claim 1 wherein said tree support has a hole in the lower end thereof, and said means mounting said tree support for rotation comprises a pin carried by said base and projecting upwardly therefrom and into said hole in the lower end of said tree support for removably connecting the tree support to said base.

3. A display stand according to claim 2 including a bearing associated with said pin and positioned between said base and the lower end of said tree support for reducing friction therebetween.

4. A display stand according to claim 1 wherein said upright support members comprise respective elongate slender rods extending upwardly in substantially parallel relation to one another.

5. A display stand according to claim 4 wherein the upper ends of said elongate rods are tapered to facilitate inserting the tree support longitudinally into the tree.

6. A display stand according to claim 4 wherein said elongate rods are of substantially equal length and substantially uniformly spaced apart.

7. A display stand according to claim 4 wherein said elongate rods have a length of at least about 3 feet.

8. A display stand according to claim 7 wherein said elongate rods are spaced apart from one another a distance less than one foot.

9. In combination, a Christmas tree having a trunk and branches extending laterally therefrom, and a rotatable display stand for supporting and displaying said tree, said display stand comprising a relatively flat base plate adapted to be positioned on the ground, a rotatable tree support positioned above said base and receiving and supporting said Christmas tree therein, and means carried by said base plate and cooperating with said tree support for removably mounting the tree support to said base plate and for permitting rotation of the tree support relative to said base to permit examining and inspecting all sides of the Christmas tree positioned therein, said rotatable tree support comprising a support platform engaging and supporting the lower end of the tree trunk and at least three elongate slender upright rods carried by said support platform and extending upwardly therefrom generally parallel to one another, said upright rods being mounted in substantially uniformly spaced apart relation from one another and substantially surrounding the tree trunk and being of a length several times greater than the spacing therebetween and such as to extend well above the lowermost branches of the tree and into the middle portions of the tree so that the tree branches extend outwardly between said upright rods and serve to assist in holding the tree in a stable upright position.

* * * * *